US005997648A

United States Patent [19]

Haar

[11] Patent Number: 5,997,648

[45] Date of Patent: Dec. 7, 1999

[54] DEVICE FOR DEPOSITING A FREE-FLOWING MEDIUM ONTO A SURFACE ALONG AN ARCUATE DEPOSITING CURVE

[75] Inventor: Thomas Haar, Halstenbek, Germany

[73] Assignee: Alfons Haar Maschinenbau GmbH & Co., Hamburg, Germany

[21] Appl. No.: 09/076,202

[22] Filed: May 21, 1998

[30] Foreign Application Priority Data

May 20, 1997 [DE] Germany ..... 197 21 029

[51] Int. Cl.[6] ..... B05C 11/00

[52] U.S. Cl. ..... 118/696; 118/323

[58] Field of Search ..... 118/663, 696, 118/697, 704, 706, 300, 305, 313, 315, 323; 239/751, 752, DIG. 14

[56] References Cited

U.S. PATENT DOCUMENTS

| | | | |
|---|---|---|---|
| 5,348,585 | 9/1994 | Weston | 118/305 |
| 5,358,568 | 10/1994 | Okano et al. | 118/323 |
| 5,520,733 | 5/1996 | Doi et al. | 118/256 |
| 5,656,085 | 8/1997 | Hezel | 118/323 |

FOREIGN PATENT DOCUMENTS 21 56 238 5/1972 Germany .

195 12 649 6/1996 Germany .

*Primary Examiner*—James Sells

*Attorney, Agent, or Firm*—Vidas, Arrett & Steinkraus, P.A.

[57] ABSTRACT

A device for depositing a free-flowing medium onto a surface of an object along an arcuate depositing curve deviating from the circular shape, with a depositing device which is connected to a supply for the medium, with a holding device for the object, with a drive device which between the holding device and the depositing device produces a relative movement such that the depositing device is moved along the depositing curve, wherein the holding device unmovably holds the object, there is provided at least one radial cam with which a cam follower is in engagement, the cam follower is coupled, via a gear transmitting a linear movement, to the depositing device, wherein the transmission of the gear is such that path of the radial cam is converted into the desired depositing path curve course, and there is provided a drive device for the cam follower.

19 Claims, 3 Drawing Sheets

DEVICE FOR DEPOSITING A FREE-FLOWING MEDIUM ONTO A SURFACE ALONG AN ARCUATE DEPOSITING CURVE

BACKGROUND OF THE INVENTION

The invention relates to a device for depositing a free-flowing medium on the surface of an object along a depositing curve deviating from the circular shape.

Metal tins whose contents are to be packed in an airtight and/or watertight manner are mostly closed with the lid placed on by way of beading the edge of the lid. The lid edge is provided with a rubber coating in order to ensure the required tightness. With round lids, i.e. corresponding to the circular shape, the rubber coating of the edges does not cause any problem. In DE 21 56 238 there it is disclosed for this purpose to rigidly arrange a nozzle and to let a lid rotate about its axis. In order to obtain a uniform deposit the angular speed, which the region to be deposited has, should be as constant as possible.

The depositing of sealing material with noncircular lids is more of a problem. For this it is already known to deposit the fluid sealing means onto the lid edge with a stamp or with a multitude of nozzles (needle valves) arranged next to one another corresponding to the shape of the lid. Both methods do not lead to a satisfactory result. The so-called stamping method does not always lead to a uniform deposit so that the quality of sealing is not satisfactory. With a multitude of nozzles, although a relatively uniform deposit is obtained, there is however the danger that disturbances occur and already with the breakdown of one nozzle the uniformity of the deposit is no longer ensured. Furthermore there arises difficulties when the interruption of operation occurs since the coating medium hardens.

From DE 195 12 649 there has become known a device with which the receiver for a lid is displaceably mounted and comprises a toothed disk corresponding to the contour of the lid, whose neutral line corresponds to the center line of the lid edge to be rubber coated. With the toothed disk there meshes a gearwheel which revolves synchronously with a main drive shaft. With the main drive shaft two radial cams are connected in a rotationally rigid manner, wherein the first radial cam so adapts the position of the square toothed disk with respect to the gearwheel that the teeth of the square toothed disk are always in engagement and the second radial cam displaces the axis of the gearwheel such that the opening of the injection nozzle is continuously located over the center line of the lid edge. This known device although ensuring a uniform deposit by way of a constant relative speed between the stationary depositing nozzle and the moved lid edge, the mechanical effort however is not unconsiderable. Furthermore it requires a complicated equipping and removal of the lid into or out of the receiver device.

BRIEF SUMMARY OF THE INVENTION

It is the object of the invention to create a simply constructed, rapid working device for depositing a free-flowing medium onto a surface along an arcuate depositing curve deviating from the circular shape, which permits a high throughput.

The invention is hereinafter described essentially by way of a rubber coating on an noncircular lid but is in now way limited to this.

It encompasses all coatings with any free-flowing material suitable for coating along an arcuate path which deviates from the circular shape.

With the device according to the invention the holding device or receiver device for the object to be coated, for example a lid, is unmovably held, i.e. the lid is unmovably held during the coating procedure. The transfer of the lid into the holding device as well as its removal may therefore be effected within the shortest time and without much expense with regard to apparatus. The depositing device, e.g. a nozzle does not need to stand at a certain original position, but rather can be continuously moved. The depositing is then controlled by controlling the coating medium, e.g. via a suitable valve. This manner of operation likewise saves time and is beneficial for the cycle time.

Further the device according to the invention envisages a radial cam which is touched by a cam follower. The movement of the cam follower is coupled via a suitable gear transmitting a linear movement to a depositing device which coats the depositing medium onto the object. In the normal case the coating device is formed by at least one nozzle via which the medium is deposited onto the surface to be coated. It is to be understood that also other coating means may be used. Gears with which the movement of an element can be transmitted to another element, for example suitable lever gears or likewise are known per se. Preferably the radial cam corresponds to the depositing curve, i.e. it has the same shape. This is however not obligatory. It is also conceivable by way of a suitable designed gear, to provide a radial cam deviating from the depositing curve.

The cam follower is driven by a drive device so that the cam follower is moved along the radial cam path. The drive device is then preferably designed in a manner such that the cam follower runs along the radial cam path with a constant speed. In particular if between the radial cam and the depositing path curve there is congruence then in a simple manner it is ensured that also the depositing device by way of the suitable coupling to the cam follower has a constant path speed.

The drive device contains preferably a suitable motor which drives the cam follower via a cam gear or via a numeric control. Cam gears with which a path-dependent change of speed on the drive side is obtained are known per se. For a given radial cam, a corresponding "design" of the cam gear is required so that at any point in time the same path speed of the cam follower is obtained. Particularly preferred is the use of a numerically controlled drive.

If desired by way of a suitable programming the constant path speed may be achieved independently of the course or for any course of the radial cam path. If the course of the depositing curve changes for example with other lid shapes, it is simple to carry out a corresponding reprogramming of the numerical control. With the device according to the invention therefore a reequipping for the coating of a subject along another path curve is possible with little effort and within the shortest time.

With the device according to the invention although the depositing device, for example a nozzle is moved, the movement however takes place in a spacially relatively restricted scope, specifically corresponding to the extension of the depositing curve. For this a suitable device is to be made available, but this is however no problem. The source for the medium to be deposited must be constantly connected to the depositing device. The connection may be created in a simple manner by a flexible conduit.

It is conceivable to movably arrange the radial cam and the cam follower in stationary manner or to let both move. According to one formation of the invention it is nevertheless advantageous when the radial cam is stationary and the cam follower is movably mounted on a holding component which for its part is rotatingly driven about an axis by the drive device. The cam follower according to a further formation of the invention is kept in constant engagement with the radial cam by a persuader, e.g. by a further radial cam, preferably by a spring. Since, as mentioned, the radial cam deviates from the circular shape, the holding component holding the depositing device moves relative to the rotational axis about which the holding component is set to rotate, for example by way of a numeric drive. According to one formation of the invention there are provided two radial cams which are arranged at a distance from one another with in each case a cam follower. The holding components of the cam follower are synchronously rotatingly driven by the drive device, and the cam followers are hinged to a rigid bridge on which the depositing device is attached. Preferably the holding component is a slide block which is displaceably mounted on a linear slide block guide, wherein the slide block guide is rotatably mounted about the axis. With such a coupling of two cam followers each point of the bridge which is to be cinematically understood as a rigid rod, describes the same course of curve as the paths of both radial cams. Such a formation has the advantage that only relatively small masses must be moved, this being beneficial for the speed of the depositing procedure.

A rotation of the depositing device about itself does not take place. There are therefore required no rotary couplings or likewise. It is conceivable to design the radial cam such that the cam follower, for example a roller pair is forcably guided between two cam surfaces which run parallel to one another. It is also conceivable to arrange the cam follower on the outer side of a preferably closed radial cam path. On the other hand the arrangement of the cam follower on the inner side of the radial cam is preferred. For maintaining the constant engagement of the cam follower with the radial cam path there is preferably provided a spring which presses the cam follower against the radial cam.

Particularly with the last mentioned formation for the kinematics only relatively small masses are required. Since further a constant path speed is traversed the driven parts only require that force which is necessary for overcoming the friction. Therefore small cycle times may be realized.

The last described design formation of the invention is particularly advantageous when on the bridge there are arranged a multitude of depositing devices, for example depositing nozzles, so that a corresponding number of objects, for example lids may be simultaneously provided with a gumming or a coating.

As has been mentioned above a single radial cam is sufficient in order to traverse the depositing curve. On order to obtain a particularly precise guiding which is able to cope with the dynamic forces occurring on operation, one formation of the invention envisages the holding component to be linked to a first beam which is linearly guided along a first axis in two bearings which are distanced from one another and are coupled to one another, wherein at least one bearing is guided in two distanced, stationary bearings along a second axis which is perpendicular to the first axis. A guiding beam which is connected to the first bearing may with the second first bearing tenter a rigid triangle. This is the simplest embodiment, from the design point of view, of a precise transmission between the radial cam and the depositing curve. Alternatively it may also be envisaged for both first bearings to be provided with a guiding beam, wherein each is guided along a second axis in two distanced second bearings. In this manner there is created a type of cross recess with which by way of a number of linear movements a transmission of the radial cam into the depositing curve may be effected.

BRIEF DESCRIPTION OF THE DRAWINGS

The invention is hereinafter described in more detail by way of the drawings.

DETAILED DESCRIPTION OF THE INVENTION

The device represented shows the possibility of rubber coating edges of lids. As has already been mentioned above, the invention is not however limited to this application, but rather any coating along a curve may be carried out. With regard to FIG. 1 it is still to be mentioned that the holding or receiver device for the lid has been removed for the purposes of illustration.

Figure 1:
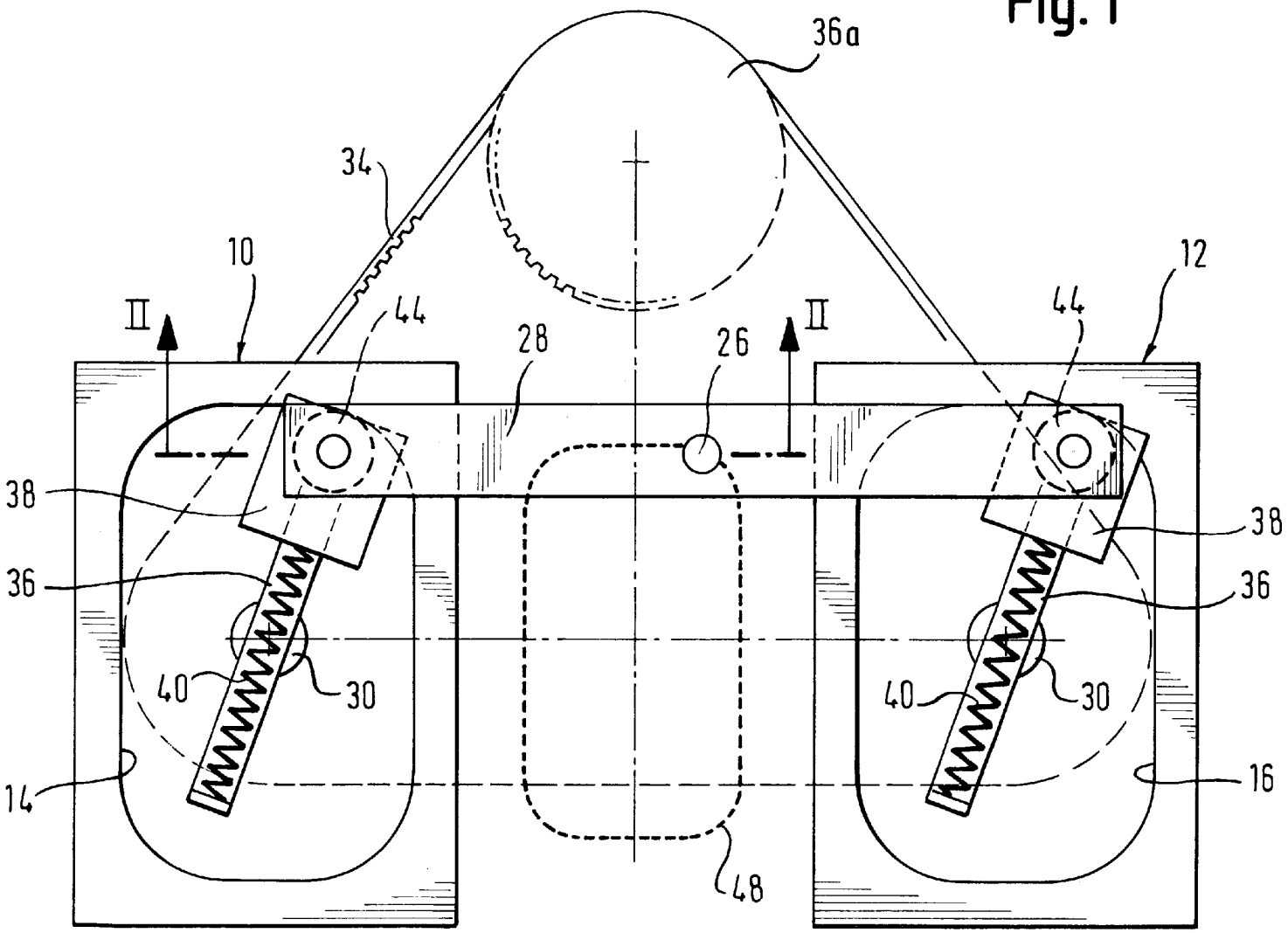
FIG. 1 shows schematically in a plan view a device according to the invention.

In FIG. 1 two cam elements 10, 12 in the form of plates or likewise are shown, these being arranged stationary and in which a radial cam 14 and 16 respectively are formed out. The holder of the elements 10, 12 is not shown in the figures.

Figure 2:
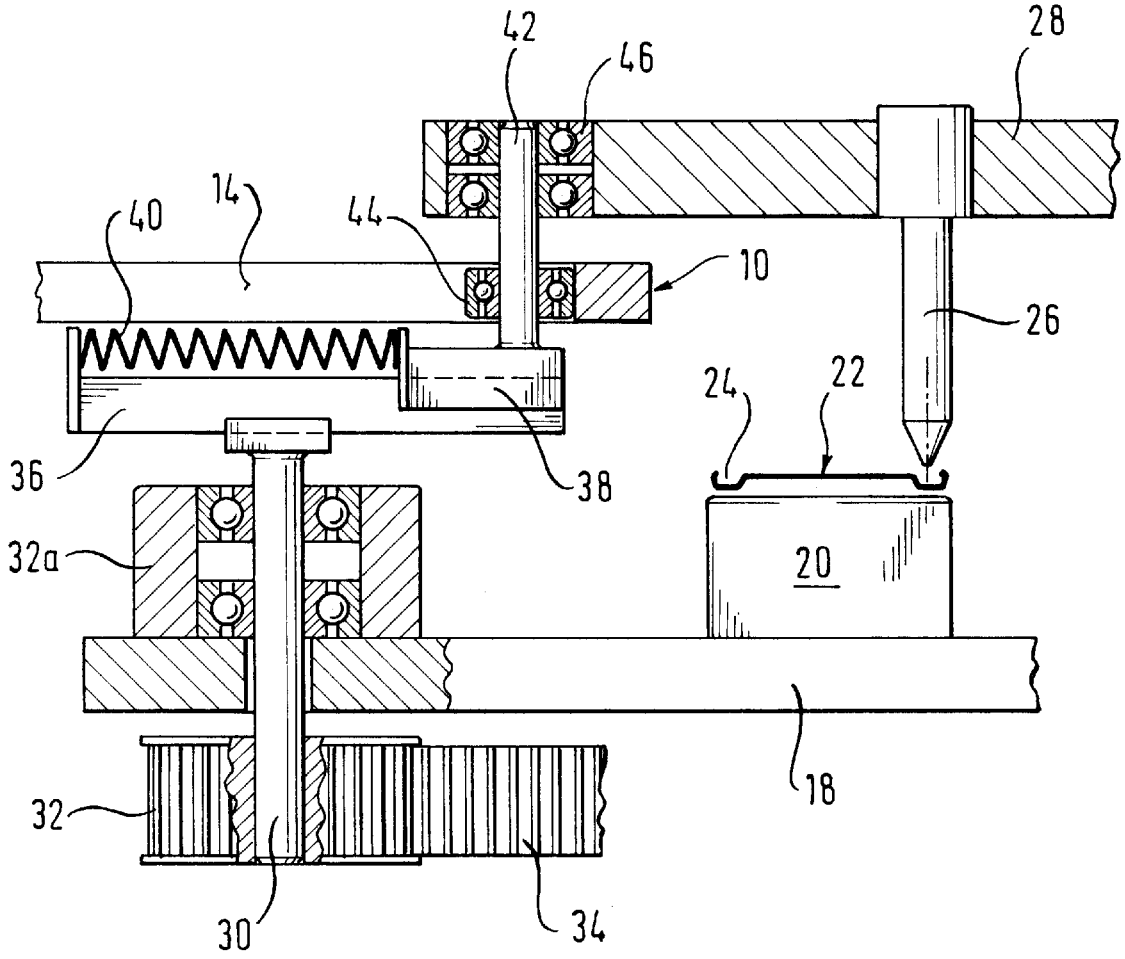
FIG. 2 shows a section through the device according to line 2—2.

In FIG. 2 a machine plate 18 is to be recognized which carries a holding or receiver device 20 for a lid 22. The lid comprises an edge 24 which is displaced to the plane of the lid and which on its inner side, which in FIG. 2 faces upwards, is to be provided with a coating, i.e. gumming. The coating is effected with the help of a nozzle 26 which is alignable to the lid edge 24 and is attached to a bridge 28 in a manner which is not described in any detail. The fastening of the nozzle 26 may be releasable in order to fix it to the bridge at another location. The nozzle 26 is connected to the source for the coating medium via a conduit which is not shown.

The machine plate 18 mounts a shaft 30 with the help of a roller bearing 32*a* arranged on the plate 18. On the lower end of the shaft 30 there sits a gearwheel 32 which meshes with a toothed belt 34. As can be recognized from FIG. 1 the toothed belt 34 is in engagement with a drive gearwheel 36*a* which is driven by a numerically controlled motor (not shown).

At the upper end the shaft holds a linear sliding block guide 36 for a sliding block 38 which is pretensioned to the right by a spring 40. To the sliding block guide 36 there is rigidly connected an upright rod 42 on which a roller 44 is rotatably mounted. The roller is located at the height of the rotary cam 14. In the upper region the rod 42 is rotatably mounted in the bridge 28, formed as a triangular rod, via roller bearing 46.

In FIG. 2 only the left half of FIG. 1 is to be recognized. In FIG. 1 therefore the parts of the right half which correspond to the left half of FIG. 2 are provided with the same reference numerals.

If the drive motor drives the gearwheel 32, the shafts 30 are synchronously rotated, wherein the rollers 44 ride on the radial cams 14 or 16. The sliding block guide 36 permits the rollers to be moved correspondingly radially inwards or outwards, wherein the springs 40 ensure that a constant engagement with the radial cams 14, 16 take place. With a constant rotational speed of the drive motor the path speed of the rollers 44 would naturally be different according to which cam region the rollers 44 are located in. The numerically controlled drive motor is however programmed such that the rollers always have the same speed along the radial cam. The bridge 28 is linked to the rollers 44, thus is driven with these. Each point of the bridge therefore follows the same or a similar curve corresponding to the radial cams 14, 16. In FIG. 1 the path which the nozzle 26 describes is shown dashed and is indicated at 48. The path 48 corresponds to the course of the edge 24 of the lid 22.

One can recognize that with a suitable distance of the elements 10, 12 also several nozzles may be arranged on the bridge 28 in order to produce a multitude of path courses 48. Thus a corresponding number of lids may be rubber coated simultaneously.

The sliding block 38 may in the middle be connected to the rod 42 so that it has the same path speed as the roller 44, this further reducing the forces of mass.

Figure 3:
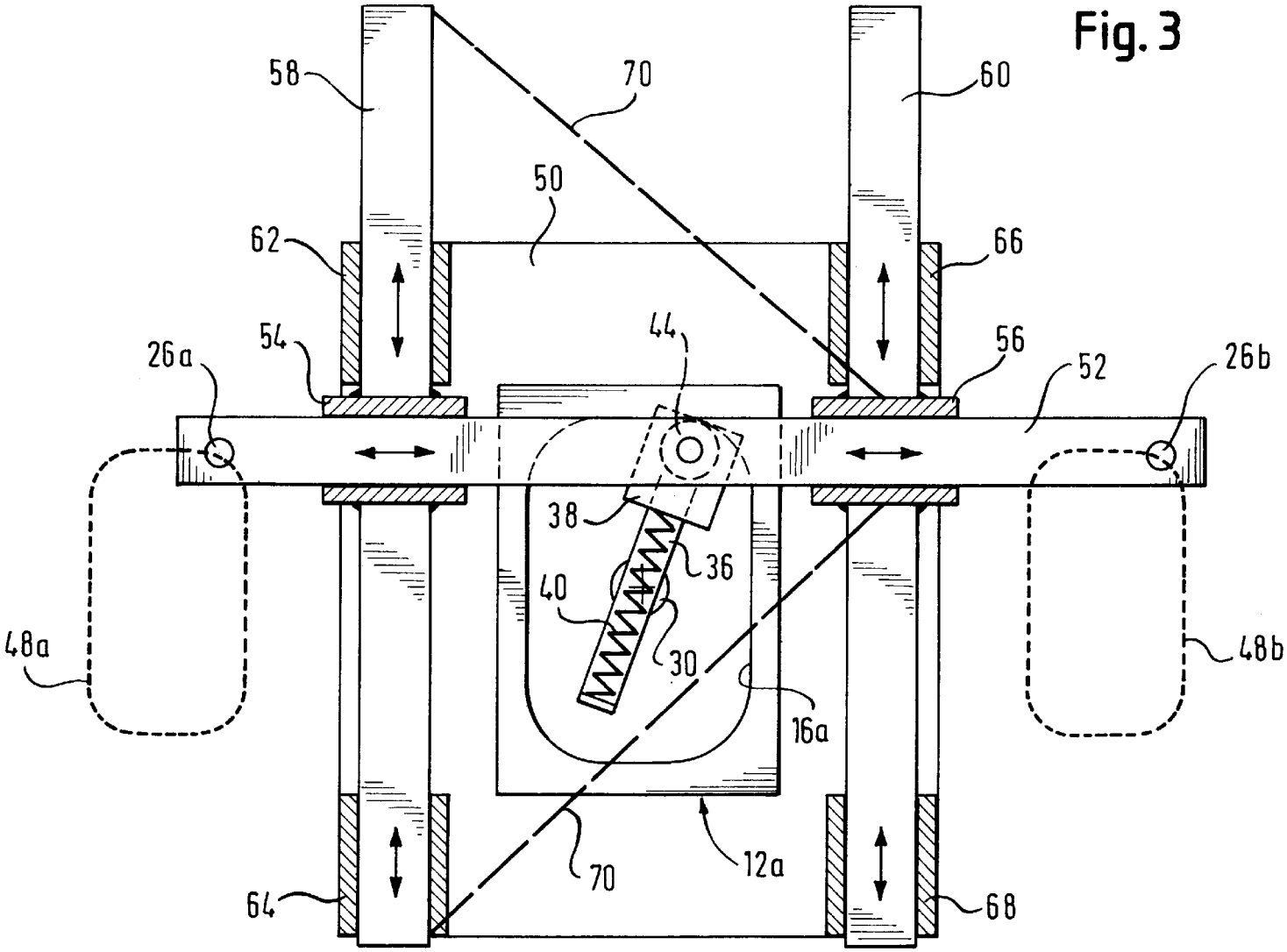
FIG. 3 schematically shows in a plan view a second embodiment form of a device according to the invention.

As far as the same parts are shown in FIG. 3 as in FIG. 1 these are provided with the same reference numerals. A single cam element 12*a* with a radial cam 16*a* is touched by a mechanism as is shown in FIG. 1. It does not therefore appear to be necessary to go into any detail here. The cam element 12*a* is rigidly mounted onto a table 50 in a manner which is not shown in any detail. The table 50 is stationary. As can be recognized the holding component 38 is linked to a first beam 52 which is linearly guided in two distanced bearings 54, 56 along a first axis (here a horizontal axis). Mounted to the first beam 52 at the ends there are depositing nozzles 26*a*, 26*b* which run along a depositing curve 48*a*, 48*b*. For this purpose the first bearings 54, 56 are provided with two guide beams 58, 60 which are arranged parallel and at a distance to one another and which are linearly guided in second bearings 62, 64 and 66, 68 respectively, in each case along a second axis which runs perpendicularly to the first axis. The second bearings 62 to 68 are rigidly connected to the table 50 and may be formed for example by bearing bushes.

With the shown design a precise guiding is possible, wherein with the beam 52 two depositing nozzles can be moved so that two lids may receive a rubber coating simultaneously.

It is also conceivable to omit a second guide beam, for example the beam 60 as well as the second bearings 66, 68 and to rigidly couple the second first bearing 56 to the guide beam 58 as is indicated by the dashed line 70. In this manner a rigid triangle is tentered. In order to obtain a precise guiding also in the plane of the drawing shown in FIG. 3 it is conceivable to so guide the beam 60 over rollers that it is guided in the plane of the drawing. The last described design possibility by its nature is a more simple design than the previously described one.

I claim:

1. A device for depositing a free-flowing medium onto a surface of an object along an arcuate depositing curve deviating from the circular shape, with a depositing device which is connected to a supply for the medium, with a holding device for the object, with a drive device which between the holding device and the depositing device produces a relative movement such that the depositing device is moved along the depositing curve, wherein the holding device unmovably holds the object, there is provided at least one radial cam with which a cam follower is in engagement, the cam follower is coupled, via a gear transmitting a linear movement, to the depositing device, wherein the transmission of the gear is such that path of the radial cam is converted into the desired depositing path curve course, and there is provided a drive device for the cam follower.

2. A device according to claim 1 wherein the drive device is formed such that the cam follower rides the radial cam with approximately constant speed.

3. A device according to claim 1, wherein the radial cam is congruent or identical to the depositing curve.

4. A device according to claim 1, wherein the drive device comprises a drive motor with a cam gear.

5. A device according to claim 1, wherein the drive device comprises a numerically controlled motor whose control program so changes the angular speed of the motor that the cam follower has a constant riding speed.

6. A device according to claim 1, wherein the radial cam is stationary and the cam follower is movably mounted on a holding component which for its part is rotatingly driven about an axis by the drive device.

7. A device according to claim 6, wherein persuading means are provided which keep the cam follower in constant engagement with the radial cam.

8. A device according to claim 7, wherein the persuading means comprise a compression spring.

9. A device according to claim 6, wherein there are provided two radial cams arranged at a distance from one another in each case with a cam follower, the holding components of the cam followers are synchronously driven by the drive device and the cam followers are linked to a rigid bridge to which the depositing device is connected.

10. A device according to claim 6, wherein the holding component is a sliding block which is displaceably mounted on a linear sliding block guide and the sliding block guide is rotatingly driven about said axis.

11. A device according to claim 1, wherein the radial cam is a closed curve.

12. A device according to claim 11, wherein the cam follower is located on the inner side of the radial cam.

13. A device according to claim 1, characterised in that the cam follower comprises a roller.

14. A device according to claim 1, wherein the depositing device comprises a depositing nozzle.

15. A device according to claim 9, wherein on the bridge a multitude of nozzles are arranged at a distance, of which to each is allocated a holding device for an object.

16. A device according to claim 6, wherein the holding component is linked to a first beam which is linearly guided along a first axis in two first bearings which are coupled to one another and are at a distance to one another, at least one bearing being guided along a second axis perpendicular to the first axis in two distanced, stationary second bearings.

17. A device according to claim 16, wherein a guiding beam for a first bearing, with the second first bearing, tenters a rigid triangle.

18. A device according to claim 17, wherein there is provided a third bearing for the guiding of the second first bearing in a plane.

19. A device according to claim 16, wherein both first bearings comprise a guiding beam which in each case are guided linearly along the second axis in two distanced second bearings.

* * * * *